US012029236B2

(12) United States Patent
Goldoni, Jr. et al.

(10) Patent No.: US 12,029,236 B2
(45) Date of Patent: Jul. 9, 2024

(54) COATED PLUG WRAP FOR A SMOKING ARTICLE

(71) Applicant: Mativ Holdings, Inc., Alpharetta, GA (US)

(72) Inventors: Marcus Aurelius Goldoni, Jr., Rio de Janeiro (BR); Carlos Eduardo da Silva Ragazzo, Rio de Janeiro (BR)

(73) Assignee: SWM Holdings US, LLC, Alpharetta, GA (US)

( * ) Notice: Subject to any disclaimer, the term of this patent is extended or adjusted under 35 U.S.C. 154(b) by 138 days.

(21) Appl. No.: 14/916,445

(22) PCT Filed: Sep. 5, 2014

(86) PCT No.: PCT/US2014/054249
§ 371 (c)(1),
(2) Date: Mar. 3, 2016

(87) PCT Pub. No.: WO2015/035137
PCT Pub. Date: Mar. 12, 2015

(65) Prior Publication Data

US 2016/0213057 A1 Jul. 28, 2016

Related U.S. Application Data

(60) Provisional application No. 61/874,240, filed on Sep. 5, 2013.

(51) Int. Cl.
*A24D 1/02* (2006.01)
*A24C 5/00* (2020.01)
(Continued)

(52) U.S. Cl.
CPC ..... *A24D 1/02* (2013.01); *A24C 5/005* (2013.01); *A24D 3/04* (2013.01); *D21H 19/20* (2013.01); *D21H 19/22* (2013.01); *D21H 23/24* (2013.01)

(58) Field of Classification Search
CPC ..... A24D 1/02
See application file for complete search history.

(56) References Cited

U.S. PATENT DOCUMENTS 3,025,861 A 3/1962 Cobb, Jr.
4,104,431 A 8/1978 Luke
(Continued)

FOREIGN PATENT DOCUMENTS

DE 145863 1/1981
EP 0758532 7/1996
(Continued)

OTHER PUBLICATIONS

Dorsch, Jim; "How to Convert a GSM to an MM", Published Sep. 26, 2017, bizfluent, <https://bizfluent.com/how-6757195-convert-gsm-mm.html>. (Year: 2017).*
(Continued)

*Primary Examiner* — Philip Y Louie
*Assistant Examiner* — Sonny V Nguyen
(74) *Attorney, Agent, or Firm* — Dority & Manning, P.A.

(57) ABSTRACT

The present invention is directed to a coated plug wrap for a smoking article. The coated plug wrap is comprised of a base paper and a coating. In accordance with the present disclosure, the base paper may be comprised of hardwood pulp fibers and optionally, softwood pulp fibers. The base paper may be coated with a coating material such as an acrylate, a styrene, a butadiene, a starch, a starch derivative, a cellulose derivative, an alginate, a polyvinyl alcohol, a polyvinyl acetate, a gelatin, a gum, or a combination thereof. In one embodiment, the coated plug wrap may be incorporated into a smoking article.

12 Claims, 1 Drawing Sheet

(51) Int. Cl.

| | |
|---|---|
| ***A24D 3/04*** | (2006.01) |
| ***D21H 19/20*** | (2006.01) |
| ***D21H 19/22*** | (2006.01) |
| ***D21H 23/24*** | (2006.01) |

(56) References Cited

U.S. PATENT DOCUMENTS

| | | | | |
|---|---|---|---|---|
| 4,548,677 | A * | 10/1985 | Schneider | D21H 5/16 162/139 |
| 4,857,126 | A | 8/1989 | Soeremark et al. | |
| 4,984,589 | A | 1/1991 | Riedesser | |
| 5,107,866 | A | 4/1992 | Aronoff et al. | |
| 5,109,876 | A * | 5/1992 | Hayden | A24D 1/02 131/365 |
| 5,570,707 | A | 11/1996 | Hill | |
| 5,595,196 | A | 1/1997 | Salonen et al. | |
| 5,654,039 | A | 8/1997 | Wenzel et al. | |
| 5,722,433 | A | 3/1998 | Ishino et al. | |
| 5,849,153 | A * | 12/1998 | Ishino | A24D 1/02 162/135 |
| 5,979,460 | A | 11/1999 | Matsumura | |
| 6,568,399 | B1 | 5/2003 | Wieczorek, Jr. et al. | |
| 6,568,402 | B1 | 5/2003 | Kaneki et al. | |
| 6,676,806 | B1 | 1/2004 | Butt, Sr. | |
| 6,959,712 | B2 | 11/2005 | Bereman et al. | |
| 7,775,217 | B2 | 8/2010 | Seymour et al. | |
| 7,833,915 | B2 | 11/2010 | Propst, Jr. | |
| 8,308,624 | B2 | 11/2012 | Travers et al. | |
| 8,327,856 | B2 | 12/2012 | Robertson et al. | |
| 8,939,155 | B2 | 1/2015 | Zitturi et al. | |
| 9,115,471 | B2 | 8/2015 | Zitturi et al. | |
| 2003/0178039 | A1* | 9/2003 | White | A24D 1/02 131/365 |
| 2009/0120450 | A1 | 5/2009 | Herve et al. | |
| 2011/0088704 | A1 | 4/2011 | Lipowicz et al. | |
| 2011/0259352 | A1 | 10/2011 | Woodcock et al. | |
| 2012/0000477 | A1* | 1/2012 | Sebastian | A24D 3/068 131/331 |
| 2013/0032158 | A1 | 2/2013 | Garrett et al. | |
| 2013/0081644 | A1 | 4/2013 | Noda et al. | |
| 2013/0199550 | A1 | 8/2013 | Ono | |
| 2014/0137880 | A1* | 5/2014 | Zitturi | A24D 1/02 131/337 |
| 2018/0092397 | A1* | 4/2018 | Pesendorfer | D21H 27/00 |

FOREIGN PATENT DOCUMENTS

| | | |
|---|---|---|
| EP | 0758695 | 7/1996 |
| EP | 1044719 | 8/1998 |
| EP | 0981971 | 7/1999 |
| EP | 2 462 821 | 6/2012 |
| EP | 2 578 093 | 4/2013 |
| EP | 2 628 400 | 8/2013 |
| WO | WO 2009/006570 | 1/2009 |
| WO | WO 2010/043475 | 4/2010 |
| WO | WO 2012/012152 | 1/2012 |
| WO | WO 2012/061249 | 5/2012 |
| WO | WO 2013/013786 | 1/2013 |
| WO | WO 2015/035137 | 3/2015 |

OTHER PUBLICATIONS

Toppan, "Zeolite functional paper "FS-ZEO"", Accessed Jul. 20, 2018 (Year: 2018).*

International Search Report and Written Opinion for International Application No. PCT/US2014/054249, dated Jan. 26, 2015.

T 227 om-99, Freeness of pulp (Canadian standard method), 1999 TAPPI, 9 pages.

T 559 cm-12, Grease resistance test for paper and paperboard, 2012 TAPPI, 5 pages.

James Casey, et al. Pulp and Paper Chemistry and Chemical Technology. Third Edition, vol. IV. A Wiley-Interscience publication. Ed. James P. Casey, New York: pp. 2470-2471.

Helsinki University of Technology, Pigment coating and surface sizing of paper (2000). FPEA and TAPPI press. Papermaking Science and Technology, Book 11, pp. 282.

Jan C. Walter, The coating processes (1993). TAPPI press, pp. 18.

Walter Reynolds, Dry strength additives (1980) TAPPI press, Table A.8.

Specification sheet for plugwrap paper of Miquel y Costas & Miquel, S.A. (Jul. 2002) named Plug wrap 26 WS. Commercially available to customers.

Specification sheet for cigarette paper of Miquel y Costas & Miquel, S.A. (Apr. 2006) named AL 113 N9. Commercially available to customers.

Specification sheet for cigarette paper of Miquel y Costas & Miquel, S.A. (Feb. 2008) named VE 423 N10. Commercially available to customers.

Specification sheet for cigarette paper of Miquel y Costas & Miquel, S.A. (Feb. 2009) named VE 116 N9. Commercially available to customers.

Specification sheet for cigarette paper of Miguel y Costas & Miguel, S.A. (Jan. 2013) named VE 118 N16. Commercially available to customers.

E-mail chain, data sheet specification and price quotation exchanged between Miguel y Costas & Miguel and a customer in relation to the preparation of a coated plug wrap (2006-2012).

Miquesl y Costas & Miquel, S.A Opposition, dated Dec. 18, 2019, 65 pages.

Julius Glatz Opposition, dated Dec. 18, 2019, 34 pages.

Ruoyuan Song et al. (2012): Effect of PVA Binder on the Mechanical Properties of Silk/Bamboo Paper-Reinforced PBS Green Composite Jun. 1, 2012, [cited Jul. 1, 2020] URL https://www.jstage.jst.go.jp/article/fiber /68/6/68_172_177/pdf.

David Weedmark: "How to convert a GSM to an MM". Downloaded from the Internet on Sep. 3, 2020, updated on Jan. 22, 2019: https://bizfluent.com/how6757195-convert-gsm-mm.html.

* cited by examiner

COATED PLUG WRAP FOR A SMOKING ARTICLE

RELATED APPLICATIONS

This application is the U.S, National Stage entry of International Application Number PCT/US2014/054249 filed under the Patent Cooperation Treaty and having a filing date of Sep. 5, 2014, and which claims priority to United States Provisional Patent Application Serial No. 61/874,240 having a filing date of Sep. 5, 2013, both of which are hereby incorporated by reference herein in their entirety for all purposes,

BACKGROUND

Smoking articles such as cigarettes are conventionally made by wrapping a column of tobacco in wrapping paper. At one end, the smoking article usually includes a filter through which the article is smoked. Filters are attached to smoking articles using a tipping paper which is glued to the wrapping paper. Although there are some exceptions, conventional filters are typically formed from cellulose acetate tows. In addition, a non-porous or porous plug wrap may be positioned between the filter and the tipping paper. The plug wrap generally holds the filter together prior to attachment to the wrapped column of tobacco. In certain applications, however, a plug wrap may not be necessary.

The components used to produce smoking articles not only provide structure but also contribute to or control many physical properties and characteristics of the smoking article. For instance, the paper can be used to adjust the rate at which the cigarette burns and the number of puffs per cigarette. The filter, plug wrap, and tipping paper can also affect other properties of the smoking article, such as tar delivery, nicotine delivery, and taste. Many of the above properties are controlled by producing papers and plug wraps with a particular permeability.

For instance, some plug wraps are lightweight papers that generally have a high porosity and permeability. In particular, these plug wraps are produced so that they do not interfere with the burn characteristics of the smoking article which can be more appropriately controlled by the cigarette wrapping paper and the tipping paper. Unfortunately, because some plug wraps need to have a very high porosity, they have relatively low strength which presents problems during formation of the paper and subsequent formation of the smoking article.

In addition, during the formation of smoking articles, adhesive glue is typically applied to the plug wrap to serve as anchor lines for the cylindrical filter tow. The adhesive can wet the paper where applied and can thus reduce the strength of the paper. In addition, after wrapping the filter tow with the plug wrap, the filter is subjected to heat and then cooled. During cooling, the filter tow and plug wrap may pick up condensation which may also weaken the paper. It is important that the paper is strong enough to withstand the forces that are being exerted on it, especially from the compacted filter tow. This loss in strength of the plug wrap can cause a failure in production.

In addition, smoking articles may contain an additive, generally an oil, with flavorings. These flavorings can aromatize the air passing through the filter. This air emerges from the filter and can be perceived and experienced by the user or smoker. The properties of the filter and plug wrap however can also affect the experience and taste of these flavorings. For instance, the flavorings or liquids may pass through the filter and plug wrap to the tipping paper. This may result in a smoking article having noticeable spots or defects that affect the appearance of the smoking article. In addition, when these flavorings or liquids escape through the filter and plug wrap, they may not be experienced by the user and they may diminish the user's enjoyment of the article. Further, air may penetrate through the surface of the plug wrap and tipping paper and dilute the smoke in the smoking article.

In view of the above, attempts have been made to increase the strength of the plug wraps or make the plug wraps moisture resistant. Attempts have also been made to prevent flavorings and oils from escaping the article. For instance, sizing agents have been applied to plug wraps in the past in order to increase the amount of moisture the paper can withstand. For instance, WO 2013/013786 to Zitturi et al., which is incorporated herein by reference in its entirety, is directed to an oil-resistant filter wrapper paper comprising at least 30 wt. % of long-fiber pulp and impregnated with a material suitable for forming an aqueous composition, such as a starch. U.S. Pat. No. 6,676,806 to Butt, Sr., which is incorporated herein by reference in its entirety, is directed to a porous plug wrap paper having a high permeability and porosity wherein the plug wrap has a sizing containing polyvinyl alcohol.

In view of the above, a need exists for a coated plug wrap for a smoking article that is of appropriate strength and inhibits or prevents flavorings from escaping through the plug wrap to the tipping paper. A need also exists for a coated plug wrap that may prevent air from diluting the aromas that are to be inhaled. As such, a need exists for providing a smoking article using conventional tobacco to provide the taste and enjoyment required by most users. Also, a need exists for a method of producing such coated plug wrap.

SUMMARY

In general, the present disclosure is directed to a coated plug wrap for a smoking article. The smoking article comprises a column, a paper wrapper, a filter, a coated plug wrap, and a tipping paper. The column comprises a smokable tobacco. The paper wrapper surrounds the column of smokable tobacco. The filter is located adjacent to one end of the column of smokable tobacco. The coated plug wrap surrounds the filter and comprises a base paper and a coating. The base paper comprises hardwood pulp fibers, softwood pulp fibers, or a combination thereof. The coating is applied to at least one surface of the base paper and comprises an acrylate, a styrene, a butadiene, or a combination thereof. The tipping paper attaches the filter to the column of smokable tobacco.

The present disclosure is also directed to a coated plug wrap comprising a base paper and a coating. The base paper comprises greater than 50% hardwood pulp fibers based on the total dry weight of the fibers. The plug wrap also comprises a coating applied to at least one surface of the base paper. The coating comprises an acrylate, a styrene, a butadiene, a starch, a starch derivative, a cellulose derivative, an alginate, a polyvinyl alcohol, a polyvinyl acetate, a gelatin, a gum, or a combination thereof.

The present disclosure is also directed to a process for preparing a coated plug wrap. The process comprises forming an aqueous slurry comprising pulp fibers in an aqueous suspension wherein the pulp fibers are comprised primarily of hardwood pulp fibers. A slurry is formed into a wet paper on a foraminous surface. The wet paper has a first surface and a second and opposite surface. A coating is applied to at least the first surface of the wet paper and comprises an acrylate, a styrene, a butadiene, or a combination thereof. The wet paper is dried before or after the coating is applied.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
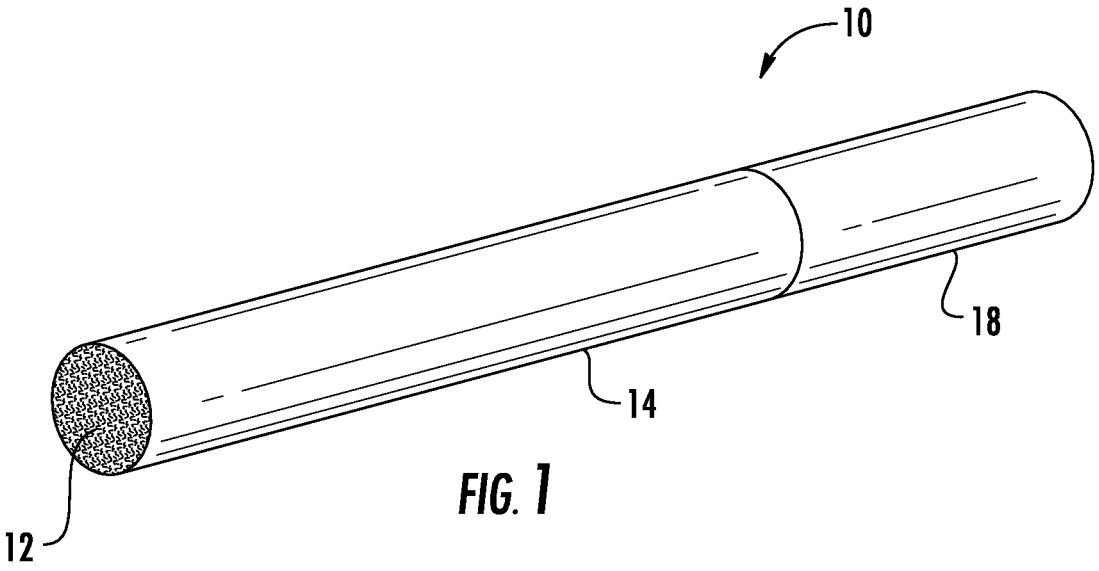
FIG. 1 is a perspective view of a conventional smoking article.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a coated plug wrap. In one embodiment, the coated plug wrap can be incorporated into a smoking article such as a cigarette. The coated plug wrap comprises a base paper having a coating applied thereto. In accordance with the present disclosure, the base paper may be comprised of pulp fibers, such as hardwood pulp fibers and softwood pulp fibers. In accordance with the present disclosure, the coating may comprise an acrylate, a styrene, a butadiene, a starch, a starch derivative, a cellulose derivative, an alginate, a polyvinyl alcohol, a polyvinyl acetate, a gelatin, a gum, or a combination thereof.

It has been discovered that combining the base paper and the coating to form the coated plug wrap of the present disclosure provides advantages and benefits, particularly when used within a smoking article. For instance, the coated plug wrap may have suitable mechanical strength and wet tensile strength for incorporation in a smoking article. When incorporated into a smoking article, the coated plug wrap of the present disclosure may provide a smoking article wherein the flavorings have a reduced tendency to escape from the smoke, through the filter and plug wrap, and to the tipping paper. In addition, the coated plug wrap may also provide a smoking article that inhibits or prevents air from diluting the smoke. The coated plug wrap according to the present disclosure may also provide oil and grease resistance as well as water resistance.

The coated plug wrap and corresponding smoking article of the present disclosure may exhibit a dramatic taste improvement over conventional non-porous and porous plug wraps. In addition, such improvements may provide a user with a better, more enjoyable experience.

As generally described above, the coated plug wrap of the present disclosure comprises a base paper containing fibers. The fibers may comprise pulp fibers such as wood pulp fibers, plant fibers, synthetic fibers, or a combination thereof. Various mixtures of these fibers may be used to vary the properties of the plug wrap, as desired.

The wood pulp fibers may comprise hardwood pulp fibers and/or softwood pulp fibers. In general, hardwood pulp fibers are derived from deciduous trees. Examples of hardwood producing trees include mahogany, walnut, oak, elm, birch, eucalyptus, and the like. In general, softwood pulp fibers are derived from coniferous trees. Examples of softwood producing trees include pine, spruce, cedar, fir, cypress, redwood, and the like. In general, hardwood fibers have a higher density than softwood fibers.

Hardwood fibers generally have an average fiber length of less than about 2 mm while softwood fibers generally have an average fiber length of greater than about 2 mm. For instance, hardwood fibers may have an average fiber length of greater than about 0.1 mm, such as greater than about 0.5 mm, such as greater than about 0.7 mm and generally less than about 2 mm, such as less than about 1.5 mm, such as less than about 1 mm, such as less than about 0.9 mm. On the other hand, softwood fibers may have an average fiber length of greater than about 2 mm, such as greater than about 5 mm and generally less than about 20 mm, such as less than about 10 mm, such as less than about 7 mm, such as less than about 3 mm.

In one embodiment, the base paper is made from at least 60% by weight, such as at least 70% by weight, such as at least 80% by weight, such as at least 90% by weight, such as at least 95% by weight of pulp fibers, such as wood pulp fibers, based on the dry weight of the base paper or the weight of a coated base paper.

According to the present disclosure, the fibers in the base paper may be primarily comprised of hardwood pulp fibers. For instance, the weight percent of hardwood pulp fibers may be greater than the weight percent of softwood pulp fibers. In one embodiment, the hardwood pulp fibers may be present in an amount of greater than about 30% by weight, such as greater than about 50% by weight, such as greater than about 70% by weight, such greater than about 80% by weight, such as greater than about 90% by weight, such as greater than about 95% by weight, based on the total dry weight of all fibers or dry weight of the pulp fibers. The hardwood pulp fibers may be present in an amount less than about 100% by weight, such as less than about 95% by weight, such as less than about 90% by weight, based on the total dry weight of the fibers. In one embodiment, the hardwood pulp fibers may be present in an amount of about 100% by weight, based on the total dry weight of all fibers or dry weight of the pulp fibers.

The base paper may comprise hardwood pulp fibers and softwood pulp fibers. The softwood pulp fibers may be present in an amount of less than about 50% by weight, such as less than about 35% by weight, such as less than about 20% by weight, such as less than about 10% by weight, such as less than about 5% by weight, based on the total dry weight of all fibers or dry weight of the pulp fibers. The softwood pulp fibers may be present in an amount greater than about 0% by weight, such as greater than about 5% by weight, such as greater than about 10% by weight, based on the total weight of the dry fibers. In one embodiment, the base paper may be substantially free of any softwood pulp fibers, such that it is present in an amount of less than about 0.5% by weight, such as less than about 0.1% by weight, such as about 0% by weight.

In one embodiment, the hardwood pulp fibers may comprise eucalyptus fibers. In particular, in one embodiment, the hardwood pulp fibers may be primarily comprised of eucalyptus fibers. For instance, the eucalyptus fibers may be present in an amount of greater than about 50% by weight, such as greater than about 70% by weight, such as greater than about 90% by weight, such as greater than about 95% by weight, based on the total dry weight of all fibers or based on the total dry weight of the pulp fibers such as the hardwood pulp fibers. In one embodiment, the hardwood pulp fibers may be entirely comprised of eucalyptus fibers, such that it is present in an amount of greater than 99% by weight, such as greater than 99.5% by weight, such as about 100% by weight.

By utilizing hardwood pulp fibers according to the present disclosure, the present inventors have discovered that the base paper may have a smooth surface for printing. In addition, the base paper may have good stiffness and bulking ability. The hardwood pulp fibers may also provide a base paper with a uniform formation. The base paper may also be easier to process and handle during manufacturing. For instance, base paper comprising hardwood pulp fibers may be easier to manipulate during the coating process and/or while manufacturing the smoking article incorporating the paper. In addition, the present inventors have discovered that base papers comprising primarily hardwood pulp fibers producing papers generally have a lower capillarity and porosity, thereby consuming less energy.

In addition, the base paper may also include mineral fillers. In general, any suitable mineral filler known in the art may be used. The filler can be, for instance, calcium carbonate, metal oxides, or a combination thereof. Suitable metal oxide particles include magnesium oxide, iron oxide, titanium dioxide, or a combination thereof. When utilized, the mineral filler(s) may be present in the base paper in an amount of less than about 15% by weight, such as less than about 10% by weight, such as less than about 5% by weight, such as less than about 4% by weight and generally greater than about 0% by weight, such as greater than about 0.5% by weight, such as greater than about 1% by weight. In one embodiment, the base paper may be substantially free of any mineral fillers, such that it is present in an amount of less than about 0.2% by weight, such as less than about 0.1% by weight, such as about 0% by weight.

In one embodiment, the base paper may comprise calcium carbonate fillers. The calcium carbonate may have a particle size of from about 0.1 μm to about 5 μm, such as from about 1 μm to about 3 μm.

In addition, the base paper may also include a strength agent, such as a dry strength agent and/or a wet strength agent. The strength agent may include modified starches such as a cationic starch, gums such as a guar gum, cellulose derivatives such as carboxymethyl cellulose, glyoxal, polyvinyl alcohol, polyacrylamides, polyamidoamine-epichlorohydrin, polyamide-epichlorohydrin, derivatives thereof, and combinations thereof. The strength agent may be present in the base paper in an amount of less than about 10% by weight, such as less than about 5% by weight, such as less than about 3% by weight, such as less than about 2.5% by weight and generally greater than about 0% by weight, such as greater than about 0.25% by weight, such as greater than about 0.5% by weight, such as greater than about 1% by weight. In one embodiment, the base paper may be substantially free of any strength agents, such that it is present in an amount of less than about 0.5% by weight, such as less than about 0.1% by weight, such as about 0% by weight.

According to the present disclosure, the coated plug wrap is also comprised of a coating. The coating provides improvements in the ability to retain flavorings within the smoke thus improving the user's experience. In particular, not to be limited by theory, the coating is believed to reduce the migration of flavors from the filter, through the plug wrap, and to the tipping paper. In addition, the coating may prevent air from entering and diluting the smoke and flavoring constituents.

The coating, in addition to being chemically stable, should also be flexible to permit subsequent manipulation of the base paper and coated plug wrap. The coating applied to the base paper may be one that requires heat or air for drying.

In general, the coating may be applied to the base paper in the form of a liquid or an emulsion. The coating may comprise an acrylate, a styrene, a butadiene, a starch, a starch derivative, a cellulose derivative, an alginate, a polyvinyl alcohol, a polyvinyl acetate, a gelatin, a gum, or a combination thereof. In one embodiment, the coating may comprise an acrylate, a styrene, a butadiene, or a combination thereof.

Suitable acrylates include butyl acrylate such as n-butyl acrylate, butyl methacrylate such as n-butyl methacrylate, ethyl acrylate, 2-ethylhexyl acrylate, ethyl methacrylate, methyl acrylate, methyl methacrylate, 2-ethylhexyl methacrylate, derivatives thereof, and the like. The coating may also include any combination of the above mentioned acrylates. In one embodiment, the acrylate may be an acrylate based monomer or polymer comprising any of the above mentioned acrylates.

Suitable styrenes include styrene such as unmodified styrene or styrene derivatives that include alkyl styrenes such as methyl styrene, ethyl styrene, butyl styrene, derivatives thereof, and the like. The coating may also include any combination of the above mentioned styrenes. In one embodiment, the styrene may be a styrene based monomer or polymer comprising any of the above mentioned styrenes.

Suitable butadienes include 1,3-butadiene and derivatives thereof and the like. The coating may also include any combination of the above mentioned butadienes. In one embodiment, the butadiene may be a butadiene based monomer or polymer comprising any of the above mentioned butadienes.

In one embodiment, the coating may be obtained by an emulsion of the aforementioned coating agents. For instance, the coating may be obtained by an emulsion of an acrylate, a styrene, a butadiene, a starch, a starch derivative, a cellulose derivative, an alginate, a polyvinyl alcohol, a polyvinyl acetate, a gelatin, a gum, or a combination thereof.

In one embodiment, the coating may be obtained by an emulsion of an acrylate(s), a styrene(s), a butadiene(s), or a combination thereof. For instance, in one embodiment, an acrylate may be emulsified with a styrene. In one embodiment, a styrene may be emulsified with a butadiene. In one embodiment, an acrylate may be emulsified with a butadiene. The emulsion may be an emulsion of acrylate, styrene, and butadiene based monomers, homopolymers, or copolymers. For instance, in one embodiment, the coating may be an emulsion of a copolymer containing acrylate and styrene monomer units or a copolymer containing styrene and butadiene units.

One commercially available emulsion comprising an acrylate and styrene that may be used according to the present invention is marketed under the trade name imPress™ by Ashland Inc.

As mentioned above, the coating may also be comprised of a starch such as corn starch, starch derivatives such as oxidized starch or carboxymethyl starch, cellulose derivatives such as carboxymethyl cellulose, methyl cellulose, hydroxyethyl cellulose, or salts thereof, polysaccharides such as alginates (sodium, calcium, magnesium, potassium), polyvinyl alcohol, polyvinyl acetate, ethylene vinyl acetate, gelatins, gums such as guar gum, locust beam gun, gum Arabic, gum tragacanth, and combinations thereof.

The amount of coating applied to the base paper to produce the coated plug wrap will depend on various factors, including the type of coating that is used and the desired result. For most applications, the coating can be present on the base paper in an amount greater than about 1% by weight, such as greater than about 3% by weight, such as greater than about 5% by weight, such as greater than about 6% by weight, such as greater than about 7% by weight and generally less than about 20% by weight, such as less than about 15% by weight, such as less than about 12% by weight, such as less than about 10% by weight, based on the dry weight of the base paper.

As described above, the base paper is generally comprised of pulp fibers such as wood pulp fibers. The base paper is generally formed from a base web comprising an aqueous suspension or slurry of fibers. The fibers are deposited onto a porous forming surface or foraminous surface, such as a flat wire or an incline wire, that allows water to drain thereby forming the base web or wet paper. The forming surface and/or downstream fabrics can include a woven pattern that may incorporate texture into the wet base paper as it is being formed.

The mineral fillers and strength agents can be incorporated into the paper using a variety of different techniques. In one embodiment, the fillers can be first combined with water or an aqueous solution to form a filler slurry. The strength agents can also be combined with water to prepare an aqueous solution. The solutions and/or slurries can be added to the suspension of fibers such that they are present within the pulp fiber suspension prior to forming the suspension or slurry into a wet base paper during the papermaking process. The resulting mixture can be spread onto a screen or porous forming surface.

According to the present disclosure, a coating is applied to produce the coated plug wrap. The coating material may be combined with water or with any suitable solvent. In one embodiment, the coating material may be present as an aqueous dispersion or emulsion or an aqueous solution. In one embodiment, the coating material may be present as a non-aqueous solution or dispersion. For instance, an alcohol may be present.

The manner in which the coating is applied to the base web or paper in accordance with the present disclosure can also vary. For instance, the coating can be applied using any technique known in the art, including bath sizing, a size press, spraying, knife coating, Meyer rod coating, gate roll size press, calendar sizing, blade coating, and the like or any suitable printing process. Printing processes that may be used include flexographic printing, gravure printing, and the like. Generally, the coating may be applied such that it is essentially invisible on the coated plug wrap.

The method of application may depend on the surface area of the base paper that is desired to be coated. In one embodiment, the coating material is applied to at least one surface of the base web or paper. In one embodiment, the coating material may be applied to both surfaces of the base web or paper. The coating may be applied while the base web is wet or after the base web has been dried.

In one embodiment, the coating can be applied to the base web as a sizing treatment using a size press. The size press may comprise a size press, a size press with an applicator roll, a size press with a rod applicator, or the like. For instance, the coating may be applied to the base web or paper after the base web or wet paper has formed but prior to any significant drying. The base web or paper generally would be dipped into a bath solution containing the coating material(s) for application. In addition, when using a size press, the base paper can be passed through rollers that press the coating into the base web and optionally remove excess coating or size. In one embodiment, the size press may be a flooded nip size press such that an excess of coating is present at the nip such that the gap may be flooded. In addition, the rolls of the size press can be controlled or regulated to obtain a desired coating thickness.

The amount of the coating material present within the size press bath solution may depend upon various factors, such as the type of coating material and the desired coating thickness. The solids content of the solution may be greater than about 1% by weight, such as greater than about 2% by weight, such as greater than about 5% by weight, such as greater than about 10% by weight and less than about 50% by weight, such as less than about 35% by weight, such as less than about 25% by weight, such as less than about 10% by weight. It should be understood that the above percentages are merely exemplary.

When applying the coating material to the base web or base paper using a size press, the coating material can be contained in the solution in amounts sufficient so that the coating material has rheological properties that make the composition amenable for application to the base web or paper at the desired concentration and thickness. For instance, the relative amounts of the coating material can be present in the solution so that the solution has a viscosity of greater than about 1 cps, such as greater than about 5 cps, such as greater than about 15 cps and less than about 100 cps, such as less than about 80 cps, such as less than about 60 cps, such as less than about 40 cps.

In one embodiment, the composition may be sprayed or printed onto the plug wrap. Any suitable printing technique may be used including flexographic printing, offset rotogravure printing, and the like. When applying the coating material to the base web or base paper using a printing process, the coating material can be contained in the solution in amounts sufficient so that the coating material has rheological properties that make the composition amenable for application to the base web or base paper at the desired concentration and thickness. For instance, the relative amounts of the coating material can be present in the solution so that the solution has a viscosity as defined above.

In one embodiment, the coating solution may have a pH of greater than 7 such as from about 7 to about 10, such as from about 7.5 to about 9, such as from about 8 to about 8.5.

The coating may be applied to the base paper or base web in an online process or offline process. In an online process, the coating is applied to the base web during the papermaking process. As such, the coating may be applied before the base web or wet paper has been substantially dried and spooled or gathered into a rod form. In an offline process, the base paper is formed, dried, and gathered into a rod form. As such, the base paper may be unwound or unspooled from a spindle, rod, or bobbin and thereafter the coating is applied.

After drying, the coated plug wrap comprising the base paper and coating may have a moisture content, such as a water content, of less than about 10% by weight, such as less than about 5% by weight and generally greater than about 0.5% by weight, such as greater than about 1.5% by weight, such as greater than about 3% by weight.

Figure 2:
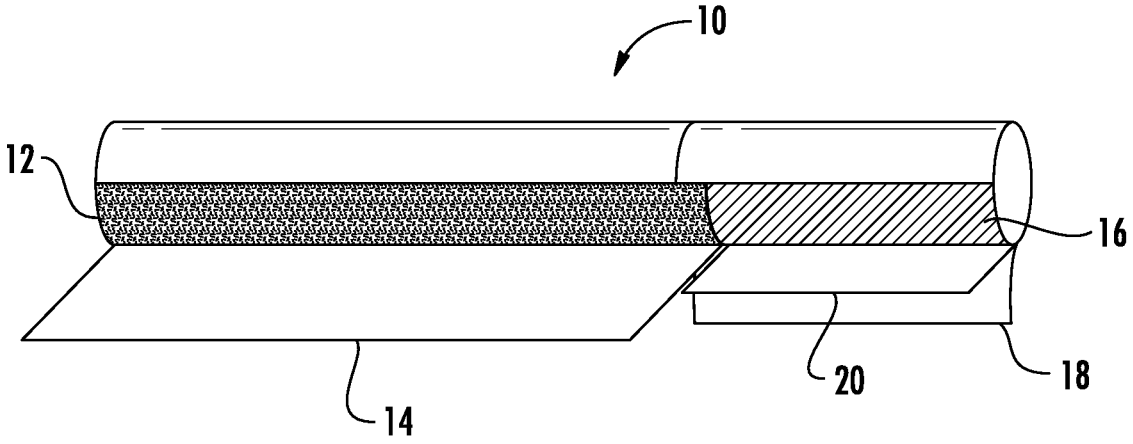
FIG. 2 is a perspective view illustrating the different components used to make the smoking article.

As indicated above, the coating is applied to the base paper to produce a coated plug wrap. The coated plug wrap may be incorporated into a smoking article. Referring now to FIGS. 1 and 2, one embodiment of a smoking article is illustrated for purposes of explanation. The smoking article illustrated in FIGS. 1 and 2 comprises a cigarette. The smoking article 10 includes a tobacco column 12 within a wrapper 14. The wrapper 14 defines an outer circumferential surface when wrapped around the tobacco column 12. The smoking article 10 may also include a filter 16 that may be held in cylindrical form by a plug wrap 20 of the present disclosure. The plug wrap 20 may hold the filter 16 together prior to attachment to the tobacco column 12 and wrapper 14 using a tipping paper 18 and an adhesive.

The smokable material contained in the tobacco column 12 can vary. The tobacco column 12 is generally made from shredded tobacco leaves and/or reconstituted tobacco. The tobacco column 12 can generally have a tobacco density of from about 150 mg/mL to about 400 mg/mL, such as from about 200 mg/mL to about 300 mg/mL, such as from about 220 mg/mL to about 250 mg/mL. Examples of suitable types of tobacco materials include flue-cured, Burley, or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut puffed stems, reconstituted tobacco material; or blends thereof.

Typically the tobacco column 12 has a length which ranges from about 55 mm to about 85 mm, preferably about 60 mm to about 70 mm; and a circumference of about 15 mm to about 27 mm, preferably about 15 mm to about 25 mm.

Typically, the filter 16 has a length which ranges from about 15 mm to about 40 mm, such as from about 20 mm to about 30 mm. The filter 16 can be comprised of any material known in the art, such as cellulose acetate.

The smoking article 10 may also comprise flavoring agents or additives, such as menthol, strawberry, grape, orange, clove, cinnamon, pineapple, vanilla, coconut, licorice, cocoa, chocolate, cherry, coffee flavorings or additives, and the like. The flavoring agent may be present within the tobacco blend or column 12, directly applied to the filter 16 material such as the cellulose acetate tow, or directly applied to the tipping paper 18 or plug wrap 20. These flavorings may enhance the user's experience with the smoking article.

The plug wrap 20 may have substantially the same width in the longitudinal direction as the filter 16. In addition, the plug wrap 20 may have substantially the same length as the length of the filter 16 in the axial direction such that the plug wrap 20 covers the outer circumference of the filter 16. According to the present disclosure, the plug wrap may comprise a 1-ply or one layer structure. However, it should be understood that the present disclosure could be utilized with multi-ply plug wraps.

Adhesive glue may be applied to the plug wrap 16 to serve as anchor lines for the cylindrical filter tow. The adhesive may be a hot melt adhesive. The adhesive may be an ethylene vinyl acetate copolymer, a polyvinyl acetate polymer, a wax, a paraffin, an ethylene/α-olefin copolymer, and the like. The adhesive may be applied to the plug wrap using spraying or printing. In addition, the present inventors have discovered that the coatings of present disclosure have a suitable interaction with ethylene vinyl acetate and polyvinyl acetate adhesives.

The tipping paper 18 may cover the entire circumference of the plug wrap 16 and also the proximal end portion of the wrapper 14.

The coated plug wrap according to the present disclosure can provide a smoking article with desired properties based on the particular application.

According to the present disclosure, the base paper used to produce the plug wrap without any coating may have a basis weight of greater than about 10 gsm, such as greater than about 15 gsm, such as greater than about 20 gsm, such as greater than about 24 gsm and less than about 50 gsm, such as less than about 40 gsm, such as less than about 35 gsm, such as less than about 31 gsm. The coated plug wrap may have a basis weight of greater than about 10 gsm, such as greater than about 15 gsm, such as greater than about 20 gsm, such as greater than about 25 gsm and less than about 50 gsm, such as less than about 40 gsm, such as less than about 35 gsm. The resulting coating may have a basis weight of greater than about 0.1 gsm, such as greater than about 0.5 gsm, such as greater than about 1 gsm, such as greater than about 1.5 gsm and less than about 10 gsm, such as less than about 5 gsm, such as less than about 4 gsm, such as less than about 3 gsm.

As indicated above, the coating is applied to at least one surface of the base web or base paper. The coating may be applied to cover at least 50%, such as at least 70%, such as at least 90%, such as at least 95% of at least one surface of the base web or paper. In one embodiment, the coating may be applied to cover about 100% of at least one surface of the base web. However, it should be understood that the coating may also be applied to a second and opposite surface of the base web or paper. In such embodiment, the coating may be applied to cover at least 50%, such as at least 70%, such as at least 90%, such as at least 95% of the second surface. In one embodiment, the coating may be applied to cover about 100% of the second surface. The coating may be applied to cover about 100% of the first surface and 100% of the second surface. Alternatively, depending on the method of application, the coating may be applied to cover each surface in different amounts.

The base paper used to produce the plug wrap without any coating may have an average thickness of greater than about 15 μm, such as greater than about 25 μm, such as greater than about 30 μm and generally less than about 50 μm, such as less than about 45 μm, such as less than about 40 μm, such as less than about 38 μm. The coated plug wrap may have an average thickness of greater than about 10 μm, such as greater than about 20 μm, such as greater than about 25 μm, such as greater than about 30 μm and less than about 50 μm, such as less than about 40 μm, such as less than about 35 μm. The total coating may have a thickness of greater than about 0.5 μm, such as greater than about 1 μm, such as greater than about 2 μm, such as greater than about 4 μm and generally less than about 12 μm, such as less than about 10 μm, such as less than about 6 μm, such as less than about 4 μm.

The coated plug wrap according to the present disclosure may be substantially non-porous. For instance, the permeability of the coated plug wrap made according to the present disclosure may be less than about 10 Coresta units, such as less than about 5 Coresta units, such as less than about 3 Coresta units and generally greater than about 0 Coresta units, such as greater than 0.25 Coresta units, such as greater than about 0.5 Coresta units, such as greater than about 1 Coresta unit. The initial permeability of the base paper without any coating may be less than about 25 Coresta units, such as less than about 20 Coresta units, such as less than about 15 Coresta units, such as less than about 10 Coresta units and generally greater than about 0.5 Coresta units, such as greater than about 1 Coresta unit, such as greater than about 2 Coresta u nits.

According to the present disclosure, the coated plug wrap may also be able to form a barrier against oil. As such, oil resistance can be measured according to TAPPI T559 cm-02. In this test, reagents, such as castor oil, n-heptane, and toluene, are combined according to standard ratios to prepare twelve kit solutions (Kit solutions 1-12). For each sample, five test specimens at least 51 mm by 152 mm are tested. An intermediate kit solution is selected and a drop is released onto the surface of the test specimen from a height of about 13 mm. After 15 seconds, the excess test solution is removed with a clean tissue or cotton swatch and the test area is immediately examined. A failure is denoted by a darkening of the test specimen which is generally due to penetration of the test solution. If the specimen fails the first test, an untested area of the same specimen is selected and the test is repeated using the next lower numbered kit solution. The test is repeated until the highest numbered kit solution that rests on the surface for 15 seconds without causing failure is identified. If however the specimen passes the first test, the test is repeated on an untested area using a higher numbered kit solution. The test is repeated until the highest numbered kit solution that does not cause failure is identified. This procedure is repeated for the remaining four specimens. Generally, higher values correspond to a higher barrier against oil. The kit solution which does not result in a failure is referred to as the kit rating. According to the present disclosure, the coated plug wrap may have a Kit rating of at least 4, such as at least 5, such as at least 6.

According to the present disclosure, the measure of the sizing of the coated plug wrap can be measured according to T 520 om-96, also known as the Hercules size test. This test allows for the determination of the time required for a dye solution to penetrate the substrate, such as the coated plug wrap. The dye solution may comprise a 100 mL solution comprising 3.5 g of a green pigment and the balance caprylic acid/capric triglyceride. The solution is poured onto the specimen and the timer is started on the Hercules tester. The Hercules size tester measures the time taken for the underside of the sample to have its reflectance decrease by 50% due to the penetration of the green dye. According to the present disclosure, the sizing of the coated plug wrap may be present such that it takes at least 1000 seconds, such as at least 1250 seconds for the dye solution to penetrate the coated plug wrap and the underside of the plug wrap to exhibit a 50% reflectance.

According to the present disclosure, the drainability or dewatering ability of the pulp can be determined according to ISO 5267. This test can provide the Canadian standard freeness as well as the Schopper-Riegler number (SR). The test is conducted generally using a conventional freeness tester comprising a chamber, a screen plate, a spreader cone, a funnel, a plug, a side orifice, and a bottom orifice. A mixture of pulp with water is disintegrated, if necessary, at a consistency of 1.2% at 20.0° C.±2° C. until no fiber bundles remain. This stock can then be diluted to a stock concentration, determined according to ISO 4119, of 0.30%±0.02% by weight at a temperature of 20.0° C.±2° C. The freeness tester is thoroughly cleaned with distilled or deionized water at 20.0° C.±0.05° C. The stock concentration is stirred and 1000 mL of the stock is collected in a clean cylinder. The temperature is taken to the nearest 0.5° C. The stock is poured into the freeness tester chamber. The top of the chamber and air cock are closed and the bottom lid is opened. After 5 seconds from the time of adding the stock is completed, the air-cock is fully opened in a single motion. When the side discharge has ceased, the volume discharged from the side orifice is recorded in milliliters to the maximum accuracy possible. The pulp consistency can be determined by collecting the pulp from the chamber along with the discharges and then drying and weighing the dried pulp. If the freeness test was conducted at a consistency greater than or less than 0.3%, the freeness value can be adjusted by subtracting or adding points, respectively. If the freeness test was conducted at a temperature greater than or less than 20° C., the freeness value can be adjusted by subtracting or adding points, respectively. The CSF value is the amount of volume discharged while also taking into consideration any correction values. The SR value is (1000-CSF)/10. For instance, if the CSF value is 750, the SR value is (1000-750)/10=25°. According to the present disclosure, the pulp used to produce the base paper and plug wrap has an SR value of greater than 30°, such as greater than 50°, such as greater than about 55°, such as greater than about 60° and generally less than about 90°, such as less than about 85°, such as less than about 80°, such as less than about 75°.

According to the present disclosure, the contact angle can be measured to determine the wettability of the surface of the coated plug wrap. In general, the contact angle is related to the interfacial energies between components, such as a liquid and air, or two liquids or a liquid and a substrate. The contact angle can be measured using a sessile drop method wherein a contact angle goniometer using an optical system captures the profile of the liquid(s) on the substrate. According to the present disclosure, a drop of water was placed on the coated plug wrap. The contact angle at the water-solid substrate interface measured through the water phase is generally greater than about 45°, such as greater than about 55°, such as greater than about 65°, such as greater than about 75° and generally less than about 90°, such as less than about 80°.

According to the present disclosure, the tensile strength and stretch of the plug wrap in the machine direction can be measured according to ISO 1924-2. The samples generally may have a width of 15, 25, or 50 mm and a length of 100 mm. The tensile strength may be at least 100 g/mm, such as at least 130 g/mm, such as at least 160 g/mm, such as at least 200 g/mm. The stretch in the machine direction may be at least 0.5%, such as at least 1%, such as at least 2%.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part.

Furthermore, those of ordinary skill in the art will appreciate that the foregoing description is by way of example only, and is not intended to limit the invention so further described in such appended claims.

The invention claimed is:

1. A coated plug wrap for a smoking article, the coated plug wrap comprising:

a base paper comprising hardwood pulp fibers and softwood pulp fibers, wherein the base paper comprises greater than 80% hardwood pulp fibers based on the total dry weight of the fibers; wherein the base paper without any coating applied has an initial permeability of about 20 Coresta units or less, wherein the coated plug wrap has a permeability of less than about 10 Coresta units;

a coating on at least one surface of the base paper, the coating comprising an acrylate, a styrene, a butadiene, a starch, a starch derivative, a cellulose derivative, an alginate, a polyvinyl alcohol, a polyvinyl acetate, a gelatin, a gum, or a combination thereof, wherein the coated plug wrap has a moisture content of less than about 10% by weight; and wherein the coated plug wrap has a Kit rating of at least 4.

2. The coated plug wrap according to claim 1, wherein the coating comprises an acrylate, a styrene, a butadiene, or a combination thereof.

3. The coated plug wrap according to claim 1, wherein the hardwood pulp fibers comprise eucalyptus fibers.

4. The coated plug wrap according to claim 1, wherein the base paper comprises calcium carbonate in an amount of less than about 10% by weight.

5. The coated plug wrap according to claim 1, wherein the coating is present in an amount of greater than about 70% of the surface area of at least one surface of the base paper.

6. The coated plug wrap according to claim 1, wherein the coated plug wrap has a thickness of from about 10 μm to about 35 μm and a basis weight of from about 10 gsm to about 50 gsm.

7. A smoking article comprising the coated plug wrap of claim 1.

8. The coated plug wrap according to claim 1, wherein the hardwood pulp fibers have an average fiber length of from about 0.1 mm to about 2 mm, wherein the softwood pulp fibers have an average fiber length of from about 5 mm to about 10 mm.

9. The coated plug wrap according to claim 1, wherein the base paper comprises a mineral filler in an amount of less than about 15% by weight.

10. The coated plug wrap according to claim 1, wherein the base paper comprises a wet strength agent.

11. The coated plug wrap according to claim 1, wherein the coated plug wrap has a contact angle with water of about 45° or more.

12. The coated plug wrap according to claim 1, wherein the coating has a thickness of greater than 0.5 μm and less than about 12 μm.

* * * * *